US011440165B2

(12) United States Patent
Hu

(10) Patent No.: US 11,440,165 B2
(45) Date of Patent: Sep. 13, 2022

(54) QUICK RECIPROCATING WRENCH

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 332 days.

(21) Appl. No.: 16/813,182

(22) Filed: Mar. 9, 2020

(65) Prior Publication Data

US 2020/0376632 A1 Dec. 3, 2020

(30) Foreign Application Priority Data

May 31, 2019 (TW) ..... 108118871

(51) Int. Cl.
*B25B 13/34* (2006.01)
*B25B 23/00* (2006.01)

(52) U.S. Cl.
CPC ..... *B25B 13/34* (2013.01); *B25B 23/0007* (2013.01)

(58) Field of Classification Search
CPC ..... B25B 13/04; B25B 13/10; B25B 13/16; B25B 13/28; B25B 13/34; B25B 13/36; B25B 13/38; B25B 13/40; B25B 13/42; B25B 13/46; B25B 13/505; B25B 23/0007; B25B 23/00; E21B 19/161
See application file for complete search history.

(56) References Cited

U.S. PATENT DOCUMENTS 4,967,612 A * 11/1990 Sparling ..... B25B 13/04 81/111
6,799,492 B2 * 10/2004 Pearson ..... B25B 13/481 81/58
6,978,701 B1 * 12/2005 Buchanan ..... B25B 13/52 81/91.2
6,988,430 B1 * 1/2006 Putney ..... B25B 13/462 81/60
9,884,409 B2 * 2/2018 Yang ..... B25G 1/063
2018/0117741 A1 * 5/2018 Hsu ..... B25B 13/46

FOREIGN PATENT DOCUMENTS

WO 2018167520 9/2018

* cited by examiner

*Primary Examiner* — Robert J Scruggs
(74) *Attorney, Agent, or Firm* — WPAT, PC

(57) ABSTRACT

A quick reciprocating wrench includes a main body, a claw, and an elastic device therebetween. The main body includes a first jaw opening having a pivot end and a block portion. The claw includes a second jaw opening having a pivotal combination portion and a retaining portion. The pivotal combination portion is pivotally connected with the pivot end, so the claw and the main body pivotally move against each other. The fastener is engaged in the first and the second jaw openings. Distance between the block portion and the neighboring force bearing face of the fastener decreases along a direction in opposite to the expansion direction of the claw and the block portion. The largest width of the distal end of the retaining portion is greater than the smallest distance between the block portion and the first force bearing face of the fastener.

10 Claims, 11 Drawing Sheets

QUICK RECIPROCATING WRENCH

BACKGROUND OF THE INVENTION

1. Field of the Invention

The present invention relates to wrenches, and more particularly, to a quick reciprocating wrench.

2. Description of the Related Art

As shown by the wrench of U.S. Pat. No. 6,978,701, the head portion thereof has a ring component, such that the ring component is mounted around a hexagonal nut. However, when the hexagonal nut is to be fastened, after driving the nut to rotate in clockwise by 60 degrees through the wrench, the user needs to detach the wrench from the hexagonal nut along the axial direction of the nut, rotates the wrench in counterclockwise by 60 degree, re-mounts the ring component around the nut, and repeats the aforementioned wrenching operation. Such operation is time costing, and such type of wrench is not categorized under a quick operative wrench.

Also, as shown by WO2018/167520A1 "LINE WRENCH HEADS AND LINE WRENCHES", a line wrench includes a wrench head, a fixed head portion, and a pivoting head portion, wherein the pivoting head portion pivotally moves to open with respect to the fixed head portion. Further, a resilient portion is disposed between the wrench head and the pivoting head portion, such that the pivoting head portion is maintained at a closing position with respect to the fixed head portion. Therefore, the line wrench is able to be efficiently engaged with a hexagonal fastener on a pipe through the pivoting operation of the pivoting head portion with respect to the fixed head portion, thereby screwing the hexagonal fastener. However, based on the fact that the pivoting head portion capable of pivoting to open with respect to the fixed head portion, in case the resilient force of the resilient portion is insufficient during fastening the hexagonal fastener, the counterforce of the hexagonal fastener may cause the pivoting head portion to open with respect to the fixed head portion, thus resulting the skid and an torque deficiency of the fastening process. Also, if the strength of the resilient force during the fastening process is too large, a pressing difficulty may be caused, such that the wrench is difficult to be detached from the pipe.

Notably, the aforementioned patents are invented by an identical inventor. U.S. Pat. No. 6,978,701 focuses on a ring wrench or a ring spanner, which is operated with a relatively slow operation speed and not categorized as a fast operative wrench. The application WO2018/167520A1 is categorized as a line wrench. Therefore, the aforementioned two patents are not invented for serving an identical operational demand, and thus difficult to be combined for facilitating the usage thereof. Based on the fact that the two patents are invented by a single inventor and do not belong to the same category, it is clearly seen that a time-saving and useful high-torque line wrench is not obvious in the industry.

In addition, U.S. Pat. No. 9,884,409 discloses a pipe wrench, wherein the pivotal member thereof has a distal end inserted in the second recess during the fastening process of the hexagonal object. For facilitating the function, two separate pivots (first and second locking members) are required, such that the pivotal members have two different pivot centers, so as to remove the distal end of the pivotal member from the second recess. However, such design increases the structural complexity and the cost thereof, which is still not optimal. On the basis of the aforementioned patents, inventor of the present invention invented a high-precision, high-quality quick reciprocating wrench for providing an optimal convenience of usage and operation of the wrench.

SUMMARY OF THE INVENTION

For improving the issues above, a quick reciprocating wrench is disclosed. During a high-torque fastening operation, a retaining portion of a claw is allowed to achieve a blocking function with a block portion, so as to prevent the retaining portion from detaching with respect to the block portion. Thus, when applied in a situation other than an oil-pipe work site, the present invention is still stably engaged with the fastener and prevents a disengagement during the wrenching process. Therefore, the present invention fulfills the expectation of the user during a high-torque operation, thus being a wide-range applicable quick reciprocating wrench.

For achieving the aforementioned objectives, a quick reciprocating wrench in accordance with an embodiment of the present invention is provided, comprising a main body, a claw, and an elastic device. The main body has a concavely-shaped first jaw opening, which has a pivot end on one side and a block portion on another side in opposite to the pivot end. The claw has a concavely-shaped second jaw opening, which has a pivotal combination portion on one side and a retaining portion on another side in opposite to the pivotal combination portion. The pivotal combination portion of the claw is pivotally connected with the pivot end of the main body along a pivot center, such that the claw and the main body are able to pivotally move with respect to each other. The elastic device is disposed between the main body and the claw. When the wrench is not combined with the fastener, the first jaw opening of the main body and the second jaw opening of the claw form a sealed status. When the wrench is combined with the fastener, the fastener is positioned in the first and second jaw openings, wherein the distance between the block portion and the neighboring first force bearing face of the fastener gradually decreases along a direction in opposite to the expansion direction of the claw and the block portion, and the largest width of the distal end of the retaining portion is greater than the smallest distance between the block portion and the first force bearing face of the fastener.

With such configuration, during the fastening operation, an outer retaining face of the retaining portion achieves a blocking function with the block portion, and an inner retaining face also achieves a blocking function with the first force bearing face of the fastener, such that the claw is prevented from detaching from the block portion for assuring the stable engagement status. Therefore, the separation between the claw and the main body is prevented, and the accidental detachment of the fastener and the wrench is also avoided, achieving a high-torque force imposing effect during the fastening operation.

DETAILED DESCRIPTION OF THE INVENTION

Figure 1:
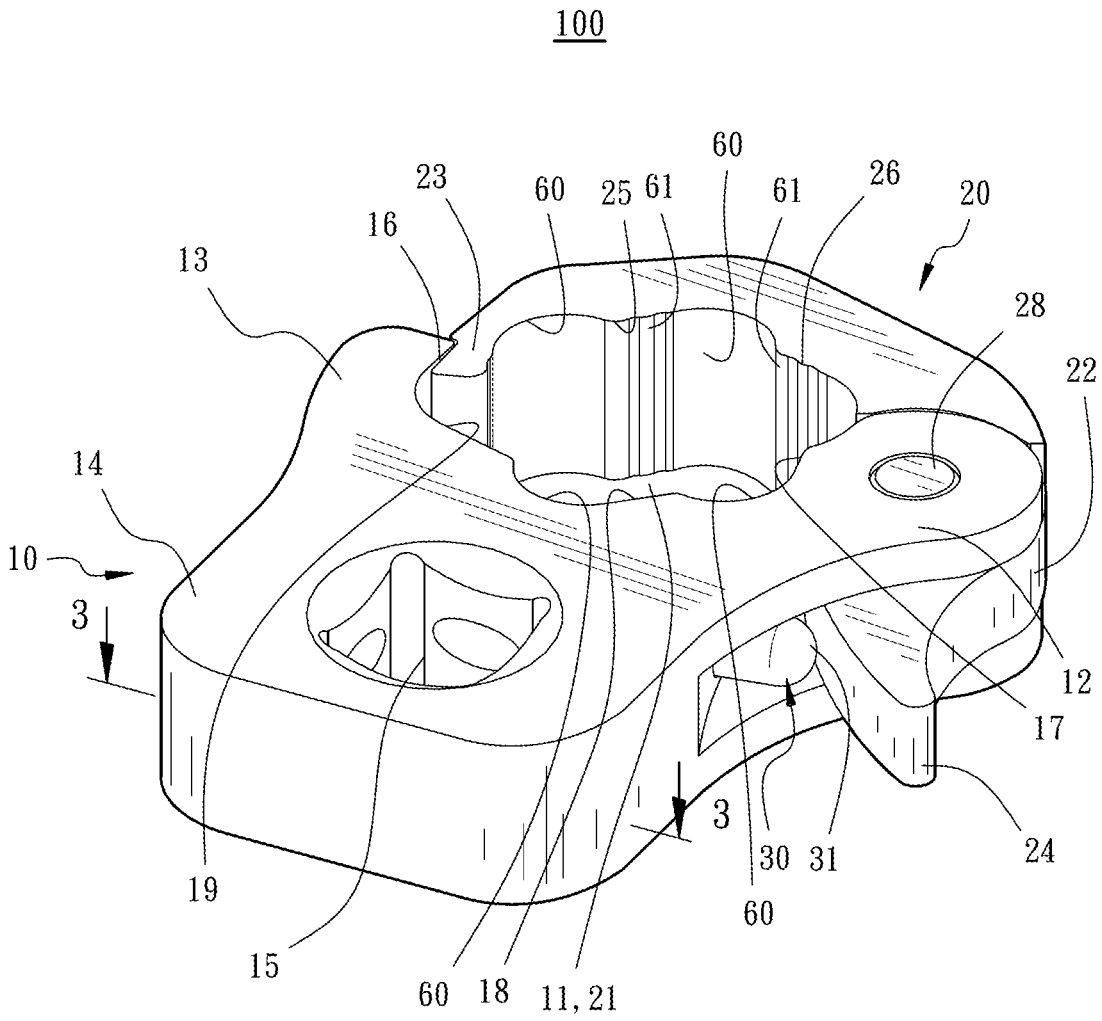
FIG. 1 is a perspective view of the quick reciprocating wrench in accordance with a first embodiment of the present invention.
Figure 2:
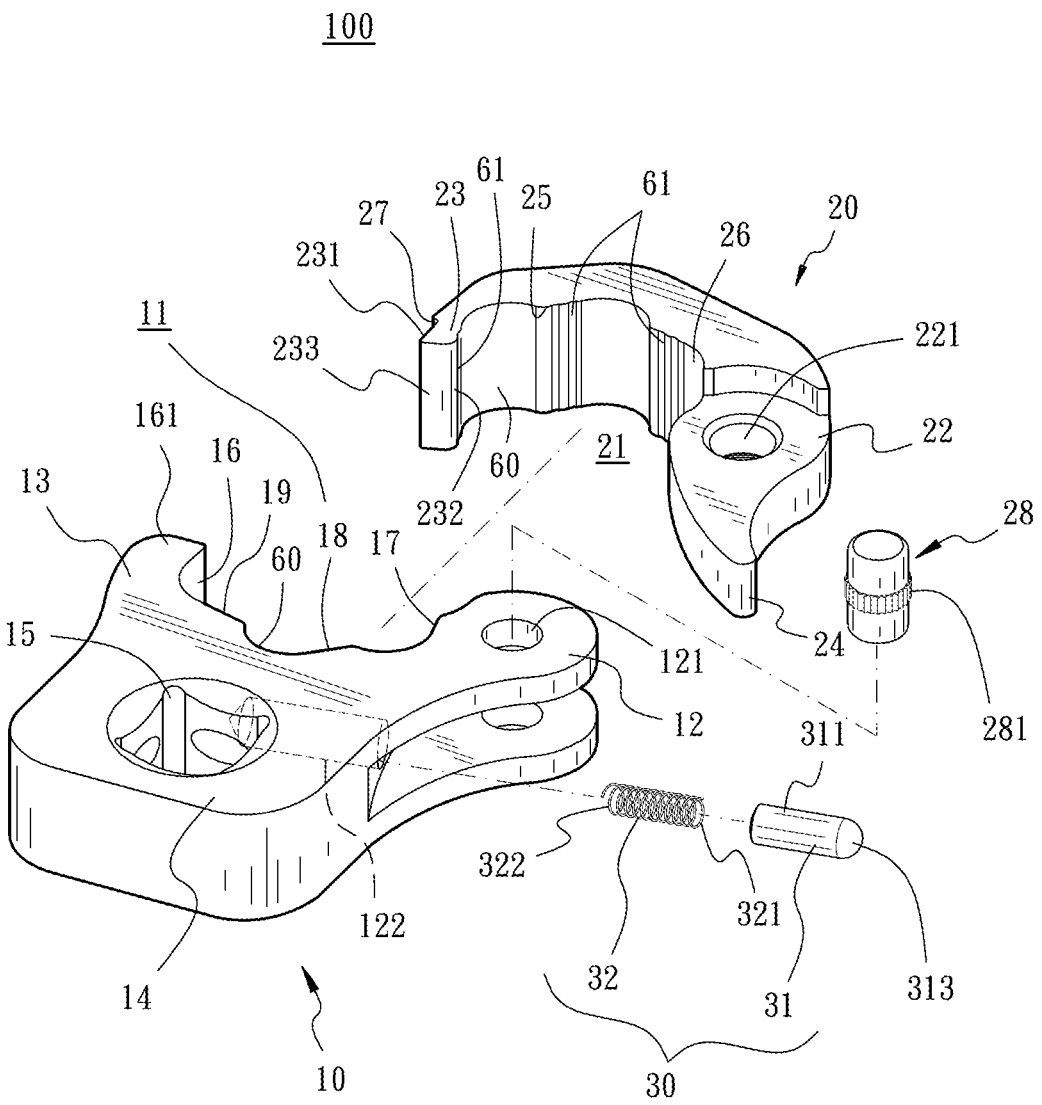
FIG. 2 is an exploded view of the quick reciprocating wrench in accordance with the first embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion. Embodiments of the present invention are illustrated in detail along with the drawings. However, the technical features included by the present invention are not limited to certain embodiments hereby provided. Scope of the present invention shall be referred to the claims, which include all the possible replacements, modifications, and equivalent features.

Referring to FIG. 1 to FIG. 9, a quick reciprocating wrench 100 in accordance with a first embodiment of the present invention is provided, comprising a main body 10, a claw 20, and an elastic device 30.

The main body 10 has a concavely-shaped first jaw opening 11. The first jaw opening 11 has a pivot end 12 on one side and a block portion 13 on another side in opposite to the pivot end 12.

The claw 20 has a concavely-shaped second jaw opening 21. The second jaw opening 21 has a pivotal combination portion 22 on one side and a retaining portion 23 on another side in opposite to the pivotal combination portion 22. The pivotal combination portion 22 of the claw 20 is pivotally connected with the pivot end 12 of the main body 10 along a pivot center C, such that the claw 20 and the main body 10 are allowed to pivotally move with respect to each other.

Figure 4:
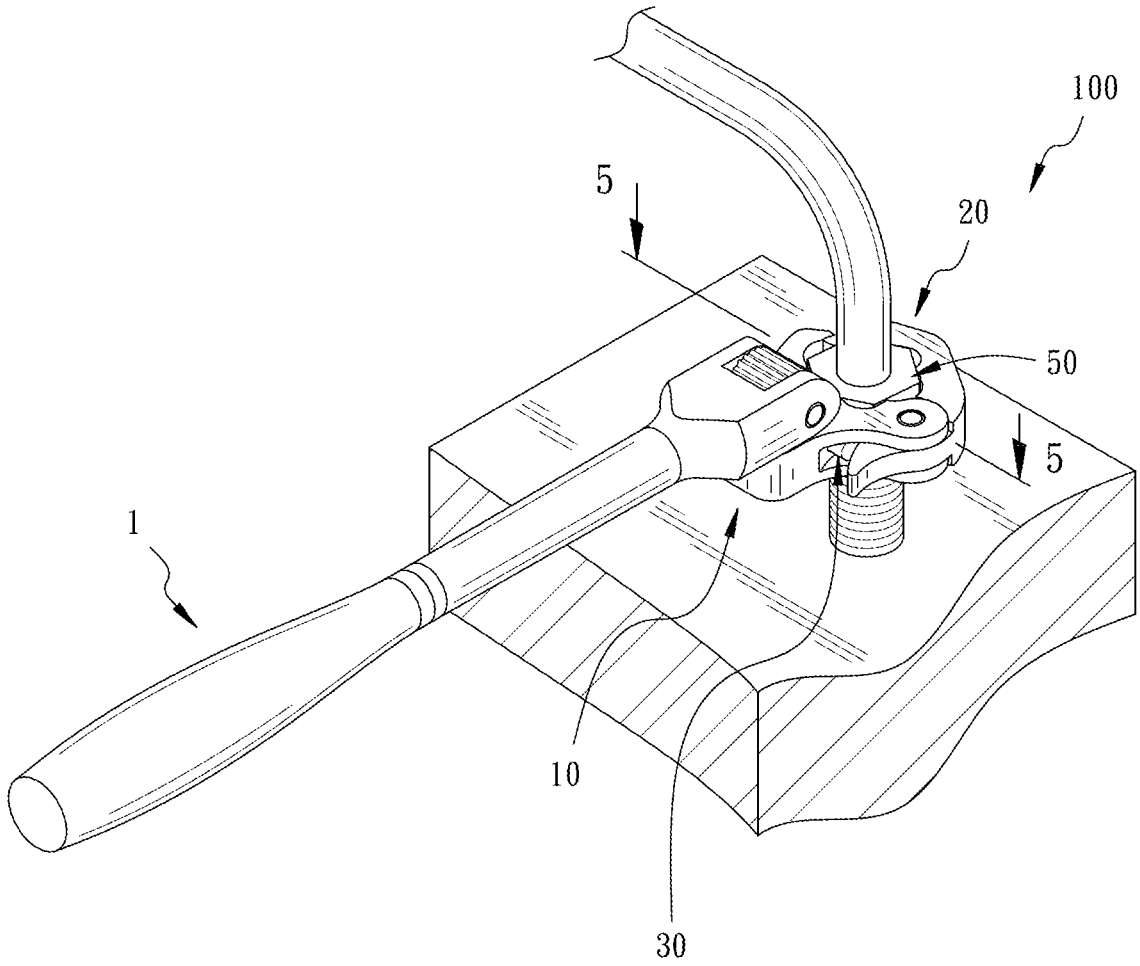
FIG. 4 is a schematic view of the quick reciprocating wrench, illustrating the wrench engaged with a fastener on a pipe, with a hand tool combined with the main body.
Figure 5:
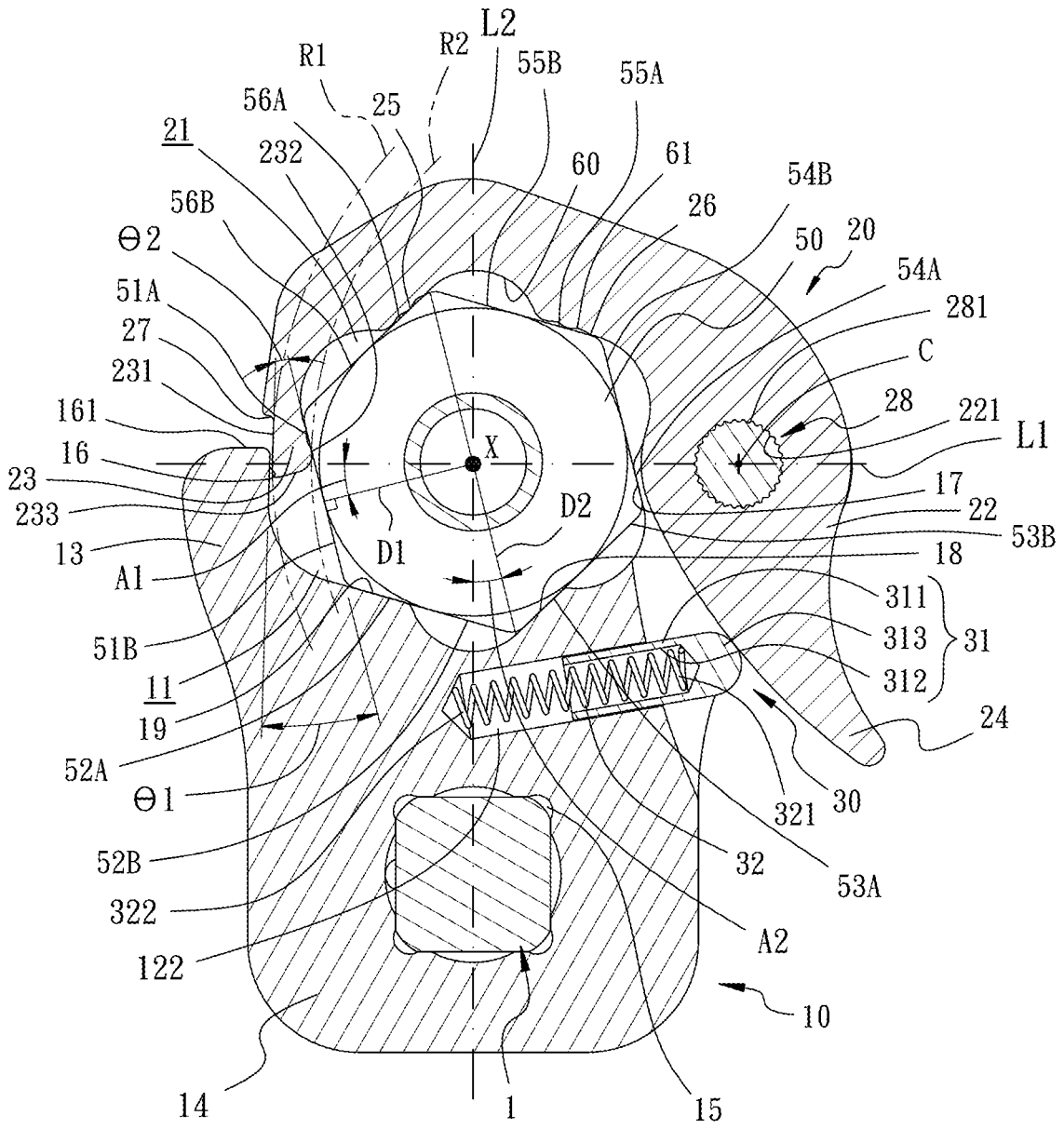
FIG. 5 is a transverse sectional view of the quick reciprocating wrench, illustrating the wrench being engaged with the fastener before driving the fastener.

The elastic device 30 is disposed between the main body 10 and the claw 20, so that the claw 20 is able to close with respect to the block portion 13, such that the wrench 100 is allowed to be engaged with the fastener 50, as shown by FIG. 4 and FIG. 5. The quick reciprocating wrench 100 is able to be engaged with the fastener 50 such as the one being disposed on a pipe, so that the fastener 50 is screwed to be fastened or loosened.

The fastener 50 is a hexagonal thread bolt, wherein a hexagonally-shaped head portion thereof sequentially has a first force bearing face 51A to a sixth force bearing face 56A sequentially disposed from the 9 o'clock direction in a counterclockwise direction. Similarly, the fastener 50 has a first obverse force bearing face 51B to a sixth obverse force bearing face 56B sequentially disposed. The wrench 100 is engaged with the fastener 50 and wrenches the fastener 50 along a rotation center X, wherein the rotation center X is the axle of the fastener 50.

When the wrench 100 is engaged with the fastener 50 for carrying out the screwing operation, the fastener 50 is positioned in the first jaw opening 11 and the second jaw opening 21.

Figure 3:
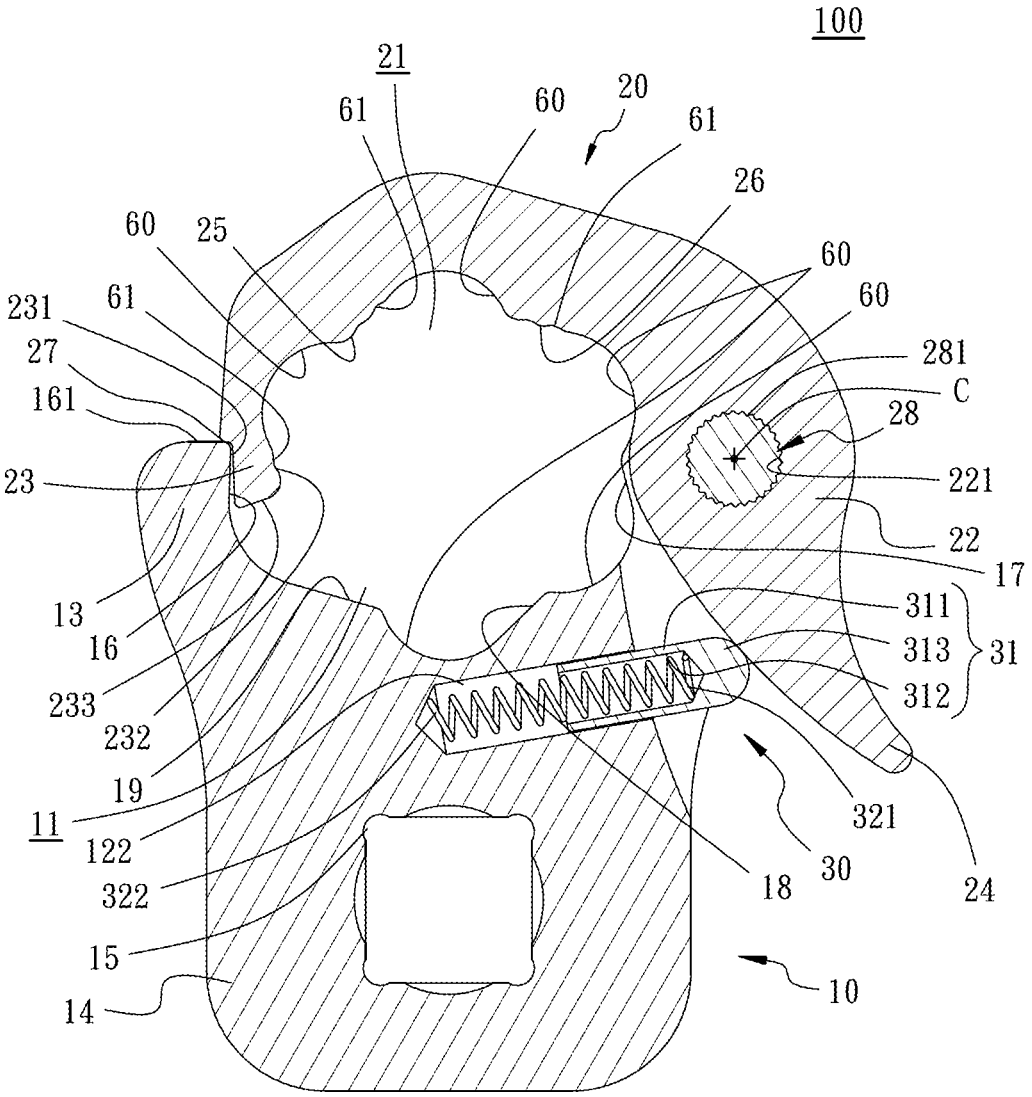
FIG. 3 is a sectional view of the quick reciprocating wrench not engaged with a fastener.

The block portion 13 has a block face 16. The first jaw opening 11 of the main body 10 further has a first forcing face 17, a second forcing face 18, and a third forcing face 19 sequentially disposed in a clockwise direction from one side of the block face 16, as shown by FIG. 3 to FIG. 5. When the wrench 100 is engaged with the fastener 50, the block face 16 faces the claw 20; the first forcing face 17, the second forcing face 18, and the third forcing face 19 face the fourth force bearing face 54A, the third force bearing face 53A, and the second force bearing face 52A of the fastener 50, respectively. Therefore, when the wrench 100 is engaged with the fastener 50, the main body 10 surrounds the three force bearing faces of the fastener 50.

The pivotal combination portion 22 of the claw 20 is pivotally connected with the pivot end 12 of the main body 10 through a single trunnion 28 along the pivot center C, such that the claw 20 and the main body 10 are able to pivotally move with respect to each other. The pivot end 12 of the main body 10 includes two pivot ears spaced with each other, and each pivot ear comprises a first pivot hole 121, respectively. The claw 20 comprises a second pivot hole 221. The trunnion 28 passes through the first pivot holes 121 and the second pivot hole 221 along the pivot center C, such that the claw 20 is pivotally connected with the main body 10. The trunnion 28 has a tooth portion 281 formed on the middle section thereof, wherein the outer diameter of the tooth portion 281 is larger than the inner diameter of the second pivot hole 221, such that the second pivot hole 221 of the pivotal combination portion 22 is fittingly engaged with the tooth portion 281. Therefore, when the trunnion 28 is disposed between the main body 10 and the claw 20, the trunnion 28 is fixed in the second pivot hole 221.

The main body 10 has an operation portion 14 formed on a position away from the first jaw opening 11. In the first embodiment, the operation portion 14 of the main body 10 comprises a combination bore 15, and the central line of the combination bore 15 passes through the main body 10 and is arranged in parallel to the rotation center X. The combination bore 15 of the main body 10 is combined with the driving end of the hand tool 1, so that the user wrenches the hand tool 1 to drive the fastener 50 through the main body 10. Therein, the hand tool 1 is a handle.

A press member 24 extends to form on the pivotal combination portion 22 of the claw 20, such that the user is able to press the press member 24 for opening the claw 20 with respect to the main body 10.

The retaining portion 23 has a shape gradually widening toward the distal end of the claw 20. The retaining portion 23 includes an outer retaining face 231 and an inner retaining face 232. The longest distance between the outer retaining face 231 and the pivot center C is a first radius R1, and the shortest distance between the inner retaining face 232 and the pivot center C is a second radius R2, wherein the first radius R1 is larger than the second radius R2. Notably, when the claw 20 pivotally sways, the claw 20 pivotally moves with respect to the main body 10 along the first radius R1 and the second radius R2. When the wrench 100 is not engaged with the fastener 50, the first radius R1 is smaller than the shortest distance from the block portion 13 to the pivot center C. When the wrench 100 is engaged with the fastener 50 for carrying out the screwing operation, the wrench 100 easily drives the fastener 50 to rotate.

The wrench 100 of the present invention comprises a first imaginary line L1 and a second imaginary line L2. As shown by FIG. 5, when the wrench 100 is engaged with the fastener 50, the first imaginary line L1 passes through the pivot center C, the rotation center X, the retaining portion 23, and the block portion 13. The second imaginary line L2 passes through the first imaginary line L1 and the rotation center X and is arranged in perpendicular to the first imaginary line L1. An outer side of the block face 16 is connected with a first connection face 161, with a second connection face 233 formed between and connecting the outer retaining face 231 and the inner retaining face 232.

When the wrench 100 is engaged with the fastener 50, the block face 16 faces the outer retaining face 231 of the claw 20, and the first forcing face 17, the second forcing face 18, and the third forcing face 19 face the fourth force bearing face 54A, the third force bearing face 53A, and the second force bearing face 52A of the fastener 50, respectively. The inner retaining face 232 faces the first force bearing face 51A of the fastener 50. Further, the claw 20 comprises a fourth forcing face 25 and a fifth forcing face 26, which face the sixth force bearing face 56A and the fifth force bearing face 55A of the fastener 50, respectively, such that the claw 20 surrounds the other three force bearing faces of the fastener 50. Meanwhile, a first inclination angle θ1 is formed by the block face 16 and the first force bearing face 51A, and a second inclination angle θ2 is formed by the outer retaining face 231 and the first force bearing face 51A. The second inclination angle θ2 is smaller than the first inclination angle θ1.

Also, as shown by FIG. 5, when the wrench 100 is engaged with the fastener 50, a first radial line D1 is formed 20 between the rotation center X and the first force bearing face 51A of the fastener 50. A first angle A1 is formed by the first radial line D1 and the first imaginary line L1. A second radial line D2 passing through the rotation center X is formed between a corner between the sixth force bearing face 56A and the fifth obverse force bearing face 55B to the opposite corner of the fastener 50. A second angle A2 is formed by the second imaginary line L2 and the second radial line D2. The first angle A1 is identical to the second angle A2; both first angle A1 and second angle A2 are 15 degrees.

In addition, a plurality of concaves 60 are disposed on the inner edge of the first jaw opening 11 and the second jaw opening 21 for facing a second obverse force bearing face 52B, a third obverse force bearing face 53B, a fourth obverse force bearing face 54B, a fifth obverse force bearing face 55B, and a sixth obverse force bearing face 56B of the fastener 50, respectively, such that the concaves 60 are able to face the five corners of the fastener 50 in the engagement of the wrench 100 and the fastener 50. Therefore, during the wrenching process, the corners of the fastener 50 are prevented from overly worn. The fourth forcing face 25, fifth forcing face 26, and the inner retaining face 232 comprise a skid proof groove 61, respectively, for preventing the skidding against the fastener 50.

The elastic device 30 is disposed between the main body 10 and the claw 20. The elastic device 30 provides a force which forces the retaining portion 23 of the claw 20 to move toward the block portion 13 of the main body 10. When the wrench 100 is not engaged with the fastener 50, the first jaw opening 11 of the main body 10 and the second jaw opening 21 of the claw 20 form a sealing status, as shown by FIG. 3, with the block face 16 and the outer retaining face 231 forming a sealed shape.

The elastic device 30 comprises a resisting member 31 and an elastic member 32. The resisting member 31 is allowed to be slidably disposed in an installation notch 122 and resist the press member 24 of the claw 20. The elastic member 32 is disposed in the installation notch 122 and pushes the resisting member 31, such that the claw 20 normally remains in a closing status with respect to the block portion 13. In the first embodiment, the elastic member 32 is a compression spring, and the resisting member 31 is a hollow pin formed of a metal material. The main body 10 has an opened installation notch 122 on the inner side of the pivot end 12. The resisting member 31 has a body portion 311 on one end, and the body portion 311 is slidably disposed in the installation notch 122 and comprises an inner bore 312 whose sectional face is formed in a circular shape. Also, the resisting member 31 has a resisting end 313 formed in opposite to the inner bore 312 and connected with the body portion 311. Also, the resisting end 313 is formed in a semi-hemisphere shape. The elastic member 32 comprises a pushing end 321 and an inner end 322. The pushing end 321 is disposed in the inner bore 312 and pushes the resisting member 31 without being exposed from the main body 10. The inner end 322 contacts the installation notch 122.

Furthermore, a position limiting portion 27 protrudes on one side of the claw 20 adjacent to the outer retaining face 231. When the wrench 100 is not engaged with the fastener 50, the position limiting portion 27 is applied for resisting against the first connection face 161 of the block portion 13, so as to prevent the elastic device 30 from overly resisting against the claw 20, avoiding the claw 20 from being jammed with the block portion 13.

Referring to FIG. 5 to FIG. 9, the operation theory and effect of the wrench 100 of the embodiment are illustrated. As shown by FIG. 5, when the wrench 100 is engaged with the fastener 50, the first forcing face 17, second forcing face 18, and third forcing face 19 of the main body 10 face the fourth force bearing face 54A, third force bearing face 53A, and second force bearing face 52A of the fastener 50, respectively; the inner retaining face 232 of the claw 20 faces the first force bearing face 51A; the fourth forcing face 25 and fifth forcing face 26 of the claw 20 face the sixth force bearing face 56A and fifth force bearing face 55A of the fastener 50. Therefore, with such configuration, the fastener 50 is surrounded by the main body 10 and the claw 20. At the same time, based on the fact that the fastener 50 is engaged in the first jaw opening 11 and the second jaw opening 21, compared with the status shown in FIG. 3, the claw 20 is currently in a slightly expanded position with respect to the main body 10.

Figure 6:
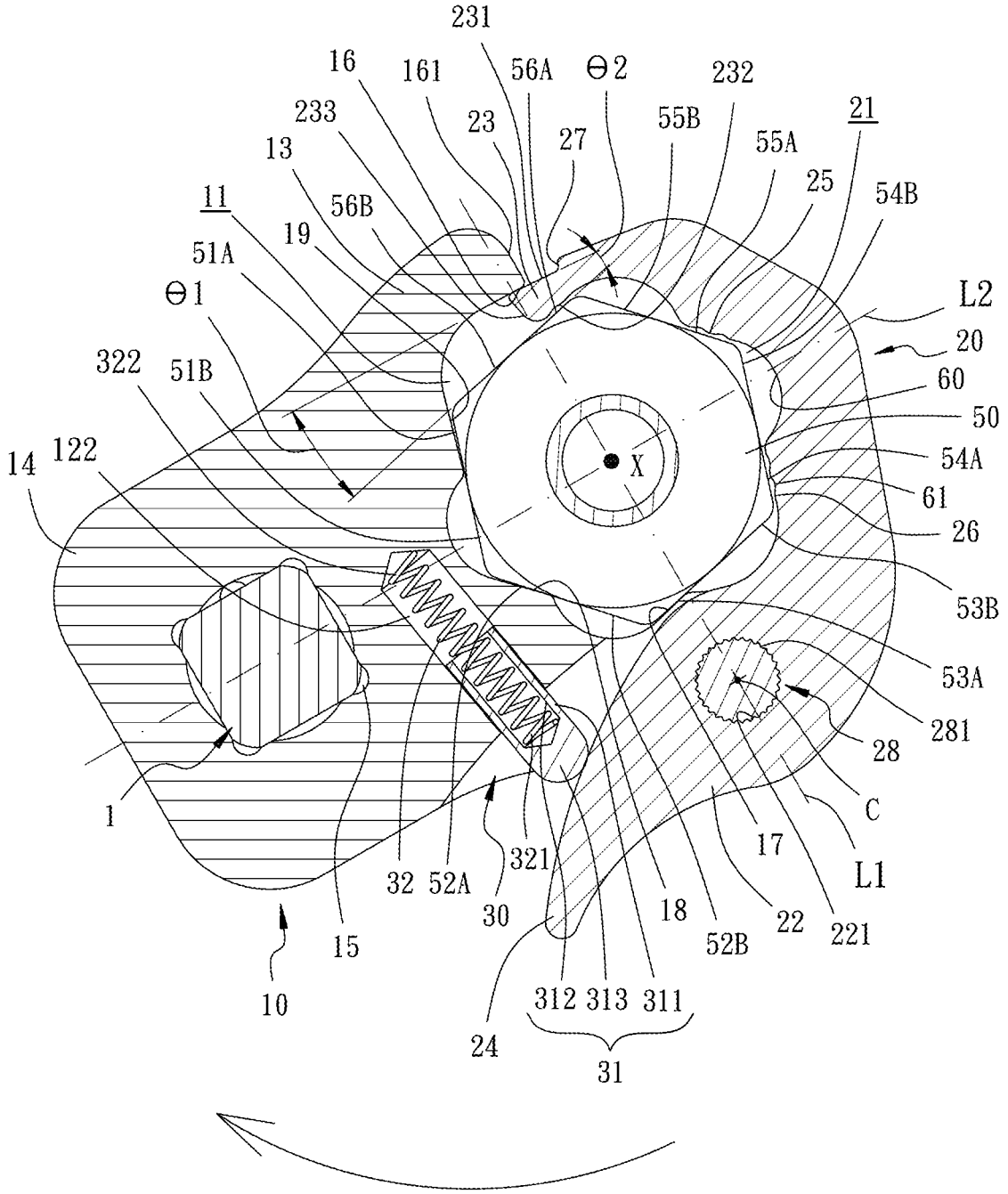
FIG. 6 is a transverse sectional view of the quick reciprocating wrench, illustrating the wrench driving the fastener toward a clockwise direction.

As shown by FIG. 6, the quick reciprocating wrench 100 is in a status of screwing the fastener 50 in a clockwise direction. Currently, the wrench 100 drives the fastener 50 to rotate about the rotation center X. The force imposed by the user is transmitted through the block face 16 and the retaining portion 23 to the first force bearing face 51A of the fastener 50. At the same time, the force imposed by the user is also transmitted through the first forcing face 17, second forcing face 18, third forcing face 19, fourth forcing face 25, and the fifth forcing face 26 to the fourth force bearing face 54A, third force bearing face 53A, second force bearing face 52A, sixth force bearing face 56A, and fifth force bearing face 55A of the fastener 50, so as to screw the fastener 50. Due to an evenly imposed force born by the fastener 50, the wrench 100 is allowed to easily drive the fastener 50 to rotate on the thread.

Figure 7:
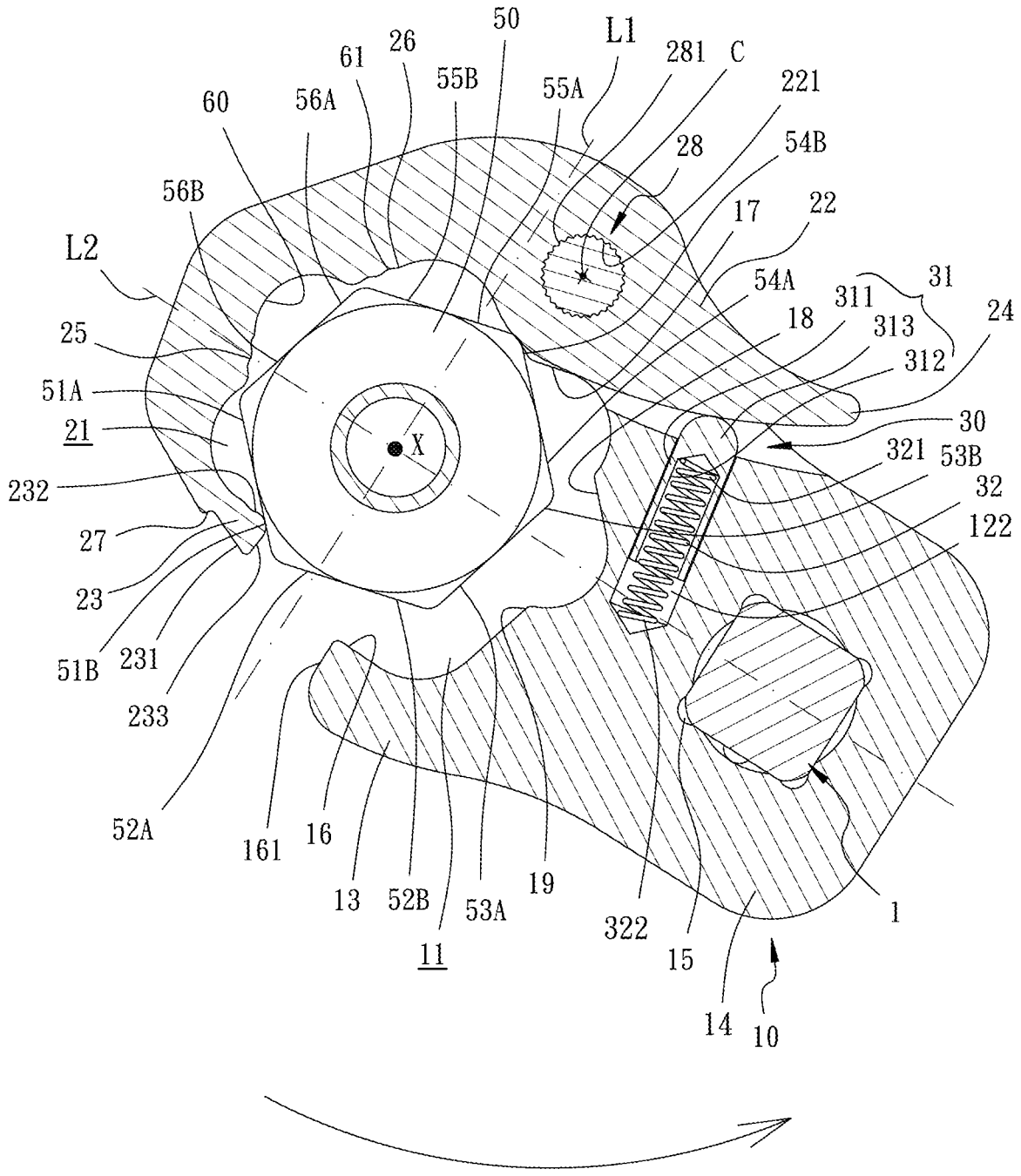
FIG. 7 is a transverse sectional view of the quick reciprocating wrench, illustrating the wrench reversely move along a counterclockwise direction.
Figure 8:
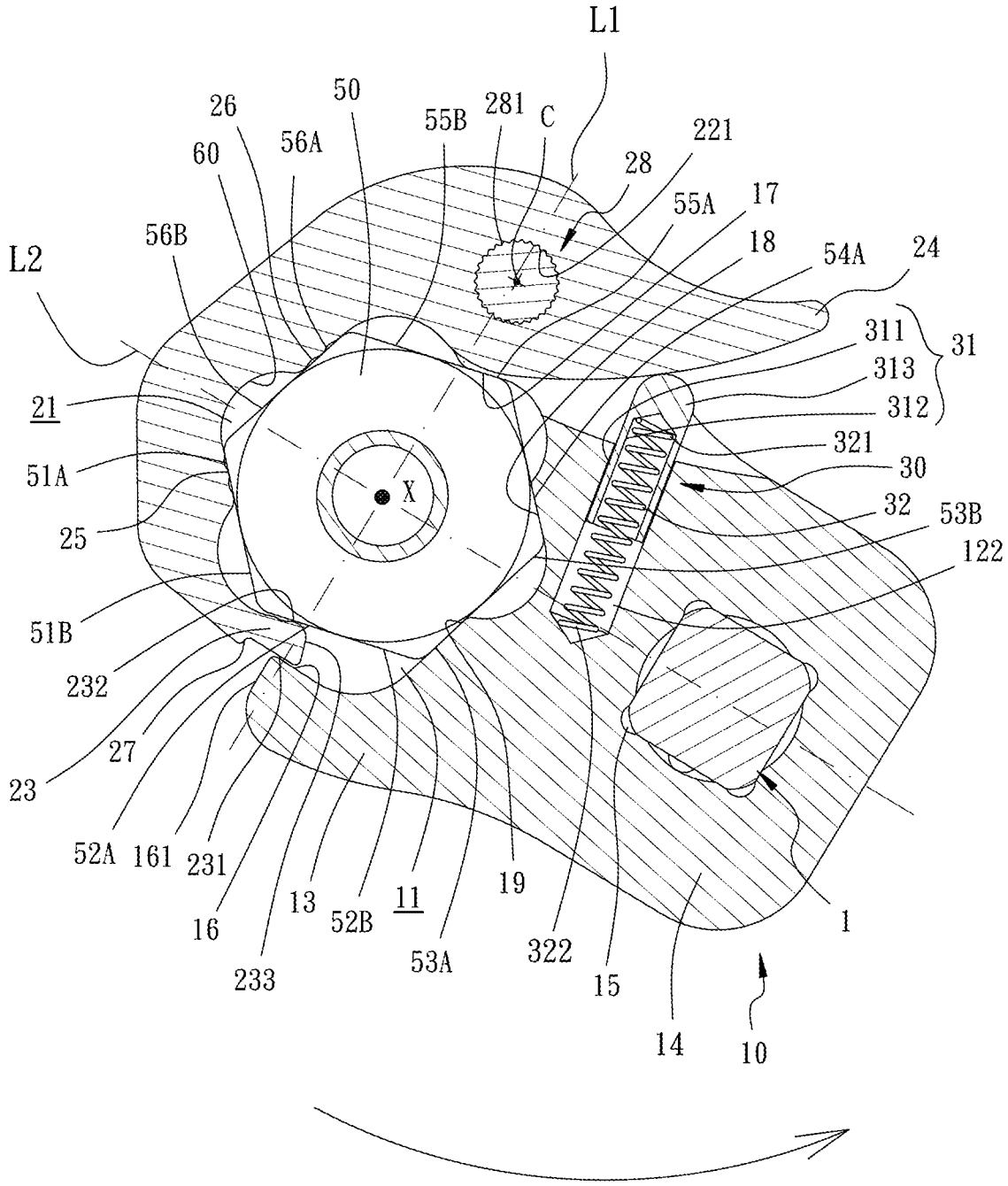
FIG. 8 is a transverse sectional view of the quick reciprocating wrench, illustrating the wrench engaged with the fastener at the next operation position after reversing by about 60 degrees.

Referring to FIG. 7, when the user wishes to efficiently reciprocate the wrench 100, the user does not have to detach the wrench 100 from the fastener 50. Instead, the user only needs to drive the main body 10 to rotate in a counterclockwise direction in accordance with the drawings, the first jaw opening 11 and the second jaw opening 21 will open with respect to the fastener 50. During such reversing operation, the main body 10 rotates about the rotation center X, so that the block portion 13 of the main body 10 moves away from the retaining portion 23 of the claw 20. With the claw 20 reversely rotating, the retaining portion 23 slides to the first obverse force bearing face 51B. Next, referring to FIG. 8, the wrench 100 is able to be reversely rotate by, for example, 60 degrees with respect to the fastener 50, so as to slidingly rotate to the next operation position. In other words, the retaining portion 23 slides to the second force bearing face 52A of the fastener 50. Then, the operation restarts from the position as shown in FIG. 5. The user repeats the operation process shown by FIG. 6 to FIG. 8, such that the fastener 50 is screwed to the target fastened position.

Figure 9:
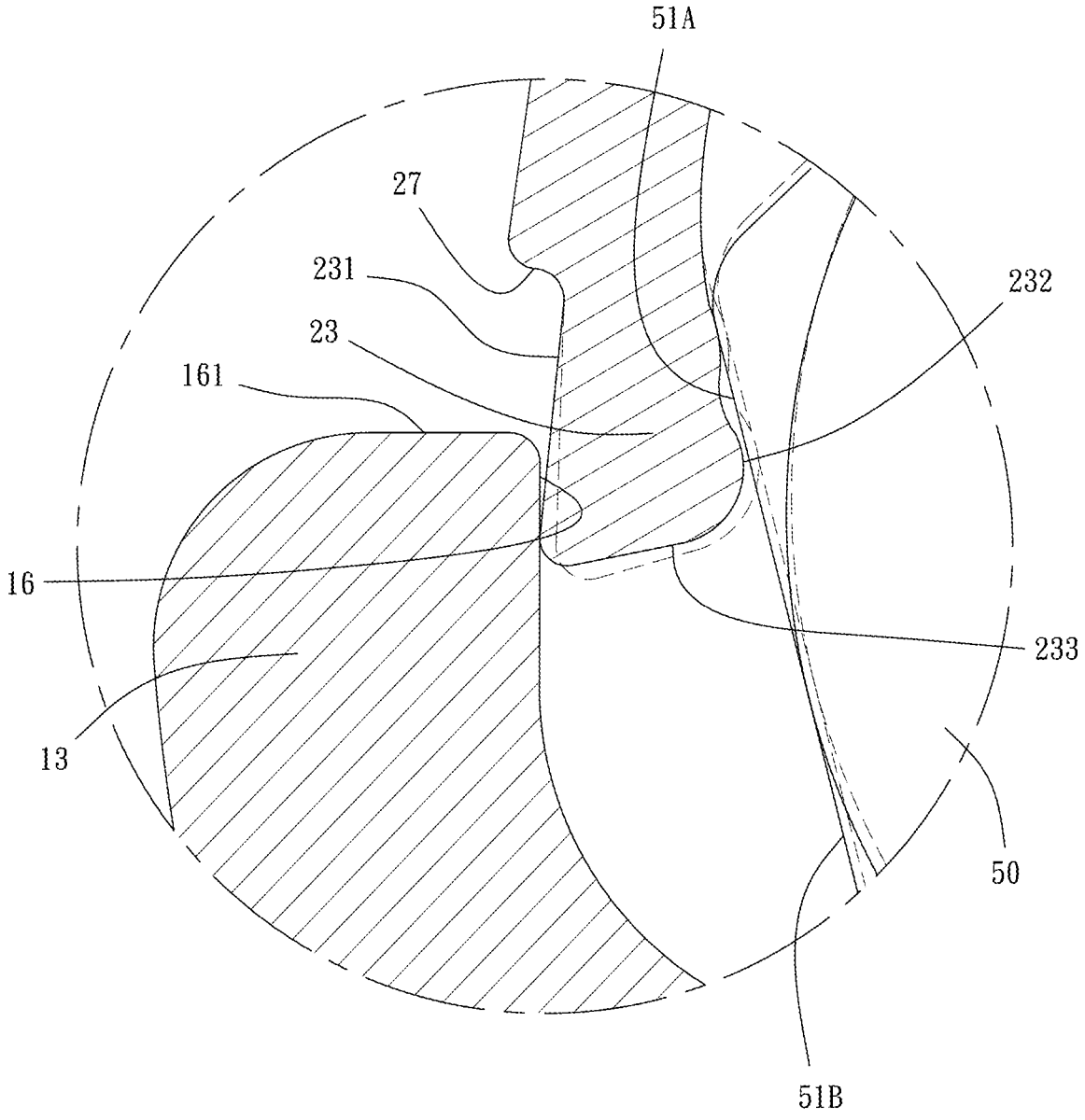
FIG. 9 is a partially enlarged schematic view of the quick reciprocating wrench, illustrating the retaining portion resisting against the block portion due to the resilient expansion thereof during the fastening process.

Referring to FIG. 9, when the fastener 50 is screwed to the target fastened position, the user may carry out the final fastening operation. The user keeps imposing the force upon the fastener 50 through the wrench 100, so that the torque value of the wrench 100 continuously increases. The distance between the block portion 13 and the neighboring first force bearing face 51A of the fastener 50 decreases along a direction in opposite to the expansion direction of the claw 20 with respect to the block portion 13; in other words, the distance between the block portion 13 and the neighboring first force bearing face 51A of the fastener 50 decreases toward a direction away from the distal end of the retaining portion 23. Then, the largest width of the distal end of the retaining portion 23 is greater than the smallest distance between the block portion 13 and the neighboring first force bearing face 51A of the fastener 50. Therefore, the counterforce of the first force bearing face 51A of the fastener 50 forces the retaining portion 23 to resiliently expand to resist against the block portion 13; in other words, the retaining portion 23 bears the counterforce to resist against the block portion 13, such that the retaining portion 23 of the claw 20 is resisted and blocked by the block portion 13 and prevented from detachment. As a result, at the fastened position, the retaining portion 23 is effectively resisted against the block portion 13, such that the claw 20 is prevented from separation and detachment with respect to the main body 10, facilitating the high-torque fastening operation. Even if the wrench 100 is applied in a high-torque fastening situation other than an oil-pipe worksite, the wrench 100 is still able to be stably engaged with the fastener 50 are prevented from detachment. Therefore, a wide-range applicable quick reciprocating wrench 100 is realized.

Thus, the quick reciprocating wrench 100 in accordance with the embodiment of the present invention achieves a quick reciprocating operation. During the fastening operation, the claw 20 is prevented from separation and detachment with respect to the main body 10, so as to assure that the main body 10 and the claw 20 are stably engaged with the fastener 50 and realize a high-torque fastening operation.

In addition, the elastic member 32 of the elastic device 30 in accordance with the present invention is disposed between the resisting member 31 and the installation notch 122 and not exposed from the main body 10. Therefore, the resilient force will not be affected due to any external objects jamming the elastic member 32. Also, the present invention applies the elastic member 32 to resist against the resisting member 31 for biasedly pressing the claw 20, and the resisting member 31 is a hollow pin formed of a metal material, with a hemispherical shaped top end. Therefore, the resisting member 31 provides a protection function upon the elastic member 32, and also prevented from being accidentally hooked by external objects to affect the operation of the elastic device 30.

Figure 10:
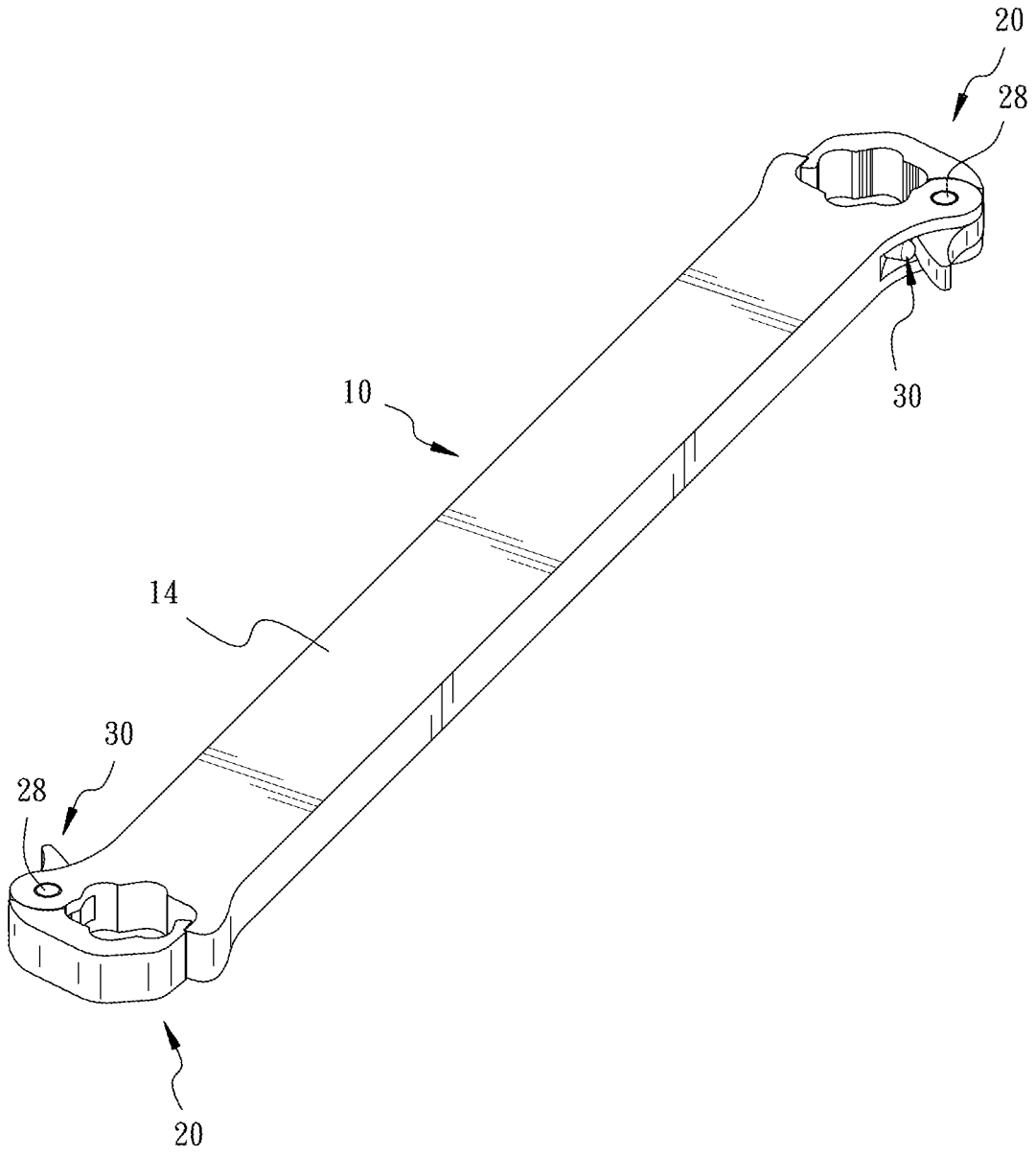
FIG. 10 is a schematic view of the quick reciprocating wrench in accordance with a second embodiment of the present invention, illustrating the wrench having double head portions and the operation portion being a handle.

Referring to FIG. 10, the quick reciprocating wrench 100 in accordance with a second embodiment is illustrated. The operation portion 14 is allowed to be a handle, such that the user is able to directly wrench the main body 10 without the necessity of applying other tools. Also, the quick reciprocating wrench 100 is able to be a double-headed structure, which further increases the utility thereof.

Figure 11:
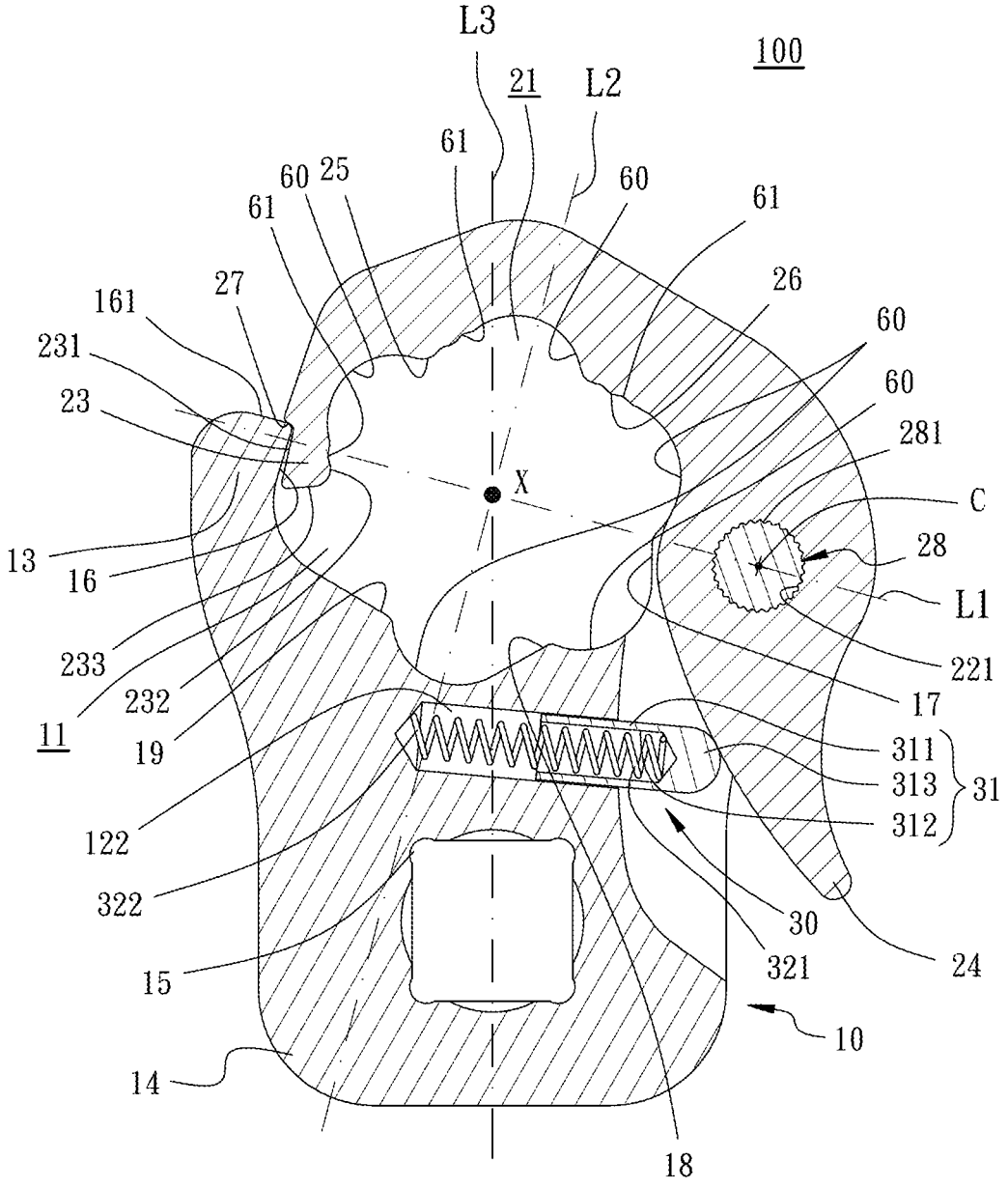
FIG. 11 is a transverse schematic view of the quick reciprocating wrench in accordance with a third embodiment of the present invention.

Referring to FIG. 11, the quick reciprocating wrench 100 in accordance with a third embodiment is illustrated. In this embodiment, identical numeric representing the same components, structures, and functions in the first embodiment are saved. Differently, the third embodiment further comprises a third imaginary line L3, which passes through the first imaginary line L1 and the rotation center X, and extends toward a length direction of the operation portion 14. Also, the second imaginary line L2 and the third imaginary line L3 include a 15-degree angle. Therefore, the claw 20 is inclined by 15 degrees with respect to the main body 10, such that a smaller width of the quick reciprocating wrench 100 is achieved, facilitating the operation in a relatively narrower space. Also, when the claw 20 is pressed with respect to the main body 10, the claw 20 moves closer to the main body 10, so as to prevent the wrench 100 from being accidentally jammed or stuck by the pipe, further facilitating the convenience of operation.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A quick reciprocating wrench, comprising:

a main body comprising a concavely-shaped first jaw opening, the first jaw opening comprising a pivot end on one side and a block portion on another side opposite to the pivot end, the block portion comprising a block face, a first inclination angle being formed by the block face and a first force bearing face of a fastener;

a claw comprising a concavely-shaped second jaw opening, the second jaw opening comprising a pivotal combination portion on one side and a retaining portion on another side opposite to the pivotal combination portion, the pivotal combination portion of the claw being pivotally connected with the pivot end of the main body along a pivot center, such that the claw and the main body pivotally move with respect to each other, wherein the retaining portion comprises an outer retaining face, a second inclination angle is formed by the outer retaining face and the first force bearing face of the fastener, and the second inclination angle is smaller than the first inclination angle; and an elastic device disposed between the main body and the claw;

wherein when the wrench is not engaged with a fastener, the first jaw opening of the main body and the second jaw opening of the claw form a sealing status;

wherein when the wrench is engaged with the fastener, the fastener is placed in the first jaw opening and the second jaw opening; a distance between the block portion and a neighboring first force bearing face of the fastener decreases in a direction in opposite to an expansion direction of the claw with respect to the block portion a largest width of a distal end of the retaining portion is greater than a smallest distance between the block portion and the neighboring first force bearing face of the fastener, and the block face and the first force bearing face of the fastener form a block effect with the retaining portion so as to prevent the retaining portion from detaching with respect to the block portion.

2. The wrench of claim 1, wherein when the wrench is engaged with the fastener during a fastening operation, a counterforce of the first force bearing face of the fastener forces the retaining portion to expand to resist against the block portion.

3. The wrench of claim 2, wherein the retaining portion comprises an opposite inner retaining face; a longest distance between the outer retaining face and the pivot center is defined as a first radius, and a shortest distance between the inner retaining face and the pivot center is defined as a second radius, wherein the first radius is larger than the second radius; when the wrench is not engaged with the fastener, the first radius is smaller than a shortest distance between the block portion and the pivot center; when the wrench is engaged with the fastener during the fastening operation, the retaining portion resiliently expands, such that the longest distance between the outer retaining face and the pivot center is greater than the shortest distance between the block portion and the pivot center.

4. The wrench of claim 3, wherein when the wrench reversely rotates, the main body rotates about a rotation center of the fastener, so that the block portion of the main body moves away from the retaining portion of the claw, and with the claw reversely rotating, the retaining portion slides to a second force bearing face of the fastener.

5. The wrench of claim 4, wherein the pivotal combination portion of the claw is pivotally connected with the pivot end of the main body through a single trunnion; the first jaw opening of the main body has a first forcing face, a second forcing face, and a third forcing face sequentially disposed in a clockwise direction from one side of the block face; when the wrench is engaged with the fastener, the block face faces the outer retaining face of the claw; the first forcing face, the second forcing face, and the third forcing face face a fourth force bearing face, a third force bearing face, and a second force bearing face of the fastener, respectively; a press member extends to form on the pivotal combination portion of the claw; the inner retaining face faces the first force bearing face of the fastener; the claw comprises a fourth forcing face and a fifth forcing face which face a sixth force bearing face and a fifth force bearing face of the fastener, respectively.

6. The wrench of claim 5, wherein a position limiting portion protrudes on one side of the claw adjacent to the outer retaining face; when the wrench is not engaged with the fastener, the position limiting portion resists against the block portion.

7. The wrench of claim 5, wherein the wrench comprises a first imaginary line and a second imaginary line; when the wrench is engaged with the fastener, the first imaginary line passes through the pivot center, the rotation center of the fastener, the retaining portion, and the block portion; the second imaginary line passes through the first imaginary line and the rotation center of the fastener and is arranged in perpendicular to the first imaginary line; a first radial line is defined between the rotation center and the first force bearing face of the fastener, and a first angle is formed by the first radial line and the first imaginary line; a second radial line is defined between a corner between the sixth force bearing face and a fifth obverse force bearing face and an opposite corner of the fastener and passes through the rotation center; a second angle is formed by the second imaginary line and the second radial line; the first angle is identical to the second angle; both first angle and second angle are 15 degrees.

8. The wrench of claim 5, wherein the wrench comprises a first imaginary line, a second imaginary line, and a third imaginary line when the wrench is engaged with the fastener, the first imaginary line passes through the pivot center, the rotation center of the fastener, the retaining portion, and the block portion; the main body comprises an operation portion formed on a position away from the first jaw opening; the operation portion comprises a combination bore, and the combination bore passes through the main body and is arranged in parallel to the rotation center; the second imaginary line passes through the first imaginary line and the rotation center of the fastener and is arranged in perpendicular to the first imaginary line; the third imaginary line passes through the first imaginary line and the rotation center, and extends toward a length direction of the operation portion; the second imaginary line and the third imaginary line include a 15-degree angle.

9. The wrench of claim 5, wherein a plurality of concaves are disposed on an inner edge of the first jaw opening and an inner edge of the second jaw opening for facing a second obverse force bearing face, a third obverse force bearing face, a fourth obverse force bearing face, the fifth obverse force bearing face, and a sixth obverse force bearing face of the fastener, respectively; the fourth forcing face, the fifth forcing face, and the inner retaining face comprise a skid proof groove, respectively; the pivot end of the main body includes two pivot ears spaced with each other, and each pivot ear comprises a first pivot hole, respectively; the claw comprises a second pivot hole, such that the trunnion passes through the two first pivot holes and the second pivot hole along the pivot center.

10. The wrench of claim 5, wherein the main body comprises an installation notch which having one opened end; the elastic device comprises a resisting member and an elastic member, the resisting member is slidably disposed in the installation notch and resists the press member, the elastic member is disposed in the installation notch and pushes the resisting member; the resisting member comprises an inner bore, and the elastic device comprises a pushing end and an inner end; the pushing end is disposed in the inner bore and pushes the resisting member; the inner end contacts the installation notch; the resisting member is a hollow pin formed of a metal material; the resisting member has a resisting end formed in opposite to the inner bore; the resisting end is formed in a semi-hemisphere shape; the resisting member has a body portion slidably disposed in the installation notch; the inner bore is concavely formed from the body portion; and the elastic member is a compression spring.

* * * * *